United States Patent [19]

Sheffer

[11] Patent Number: 4,643,349

[45] Date of Patent: Feb. 17, 1987

[54] PROMOTIONAL DELIVERY VAN ASSEMBLY

[75] Inventor: Phil B. Sheffer, New Oxford, Pa.

[73] Assignee: Merchandising Innovations Co., Inc., Hanover, Pa.

[21] Appl. No.: 838,763

[22] Filed: Mar. 12, 1986

[51] Int. Cl.[4] ..... B65D 5/00

[52] U.S. Cl. ..... 229/8; 206/457; 446/73; 446/93; 446/488; D9/308

[58] Field of Search ..... 229/8, 27, 28 R; 446/73, 75–78, 93–95, 80, 488; D9/308, 433; 206/457

[56] References Cited

U.S. PATENT DOCUMENTS

| | | | |
|---|---|---|---|
| D. 74,522 | 2/1928 | Rozowsky | D9/308 |
| 654,219 | 7/1900 | Bender, Jr. | 446/76 |
| 979,812 | 12/1910 | Warren | 229/8 |
| 1,330,654 | 2/1920 | Pittman | 229/8 |
| 1,547,176 | 7/1925 | Lazaron | 446/77 |
| 1,553,793 | 9/1925 | Rozowsky | 229/8 |
| 2,625,315 | 1/1953 | Fehrenkamp | 229/DIG. 4 |
| 2,665,522 | 1/1954 | Junod | 446/75 |
| 2,823,844 | 2/1958 | Frankenstein | 229/8 |

FOREIGN PATENT DOCUMENTS

| | | | |
|---|---|---|---|
| 904806 | 7/1972 | Canada | 206/457 |
| 1180563 | 6/1959 | France | 229/27 |

*Primary Examiner*—William Price
*Assistant Examiner*—Gary E. Elkins
*Attorney, Agent, or Firm*—Daniel J. O'Connor

[57] ABSTRACT

A display article comprising a promotional delivery van assembly which is made entirely of corrugated fiberboard materials. A uniquely engineered series of cuts and score lines permits the article to be shipped in a completely flat or knockdown position. Upon receipt by the retail merchant, consumer or collector, the device may be readily assembled into a highly durable and attractive unit. No separate fasteners or glue of any kind are required for assembly of the unit which may be easily completed even by persons unfamiliar with display assembly techniques. It is contemplated that the device would be suitable for advertising and hobby/collector uses.

5 Claims, 2 Drawing Figures

PROMOTIONAL DELIVERY VAN ASSEMBLY

Papers relating to the present invention were previously filed under the Disclosure Document Program of the U.S. Patent Office.

BACKGROUND AND OBJECTS OF THE INVENTION

The invention relates generally to display or promotional items which are manufactured of corrugated fiberboard or other easily workable materials.

It would be highly desirable in the advertising and merchandising arts to mass produce attractive advertising articles which may be shipped in a flat or knockdown position and yet easily assembled by the retail merchant.

In particular, the invention relates to a miniature delivery van having the trademarks of a particular beverage manufacturer printed thereon.

Accordingly, it is an object of the present invention to mass produce a promotional or collector's article of inexpensive and easily manufactured materials.

It is a further objective to produce an advertising device which may be shipped in large quantities in a knockdown position and be readily assembled by the users thereof into a highly durable and attractive miniature promotional unit.

It is also an object of the present invention to provide a promotional device which has factory formed sections therein such that the device may be easily assembled without the use of separate fastener elements.

It is a further object to provide a collector's item having factory formed sections therein such that the device will be securely retained in its fully assembled position.

It is a still further object to demonstrate a promotional article which may be fabricated of lightweight materials to reduce shipping and warehousing costs in the distribution of such articles.

Further objects and advantages of the present invention will become apparent as the following description proceeds, and the features of novelty characterizing the invention will be pointed out with particularity in the claims annexed to and forming a part of this specification.

In production of the promotional device, a flat sheet of corrugated fiberboard material is die cut into a uniquely engineered design which allows the flat sheet to be readily assembled by the user into a durable and highly attractive display item designed to enhance retail sales of a particular product.

PRIOR ART PATENTS

The most relevant prior art patents presently known to the inventor herein are listed as follows: U.S. Pat. No. 4,055,250 issued to Mayhew on Oct. 25, 1977 and U.S. Pat. No. 935,865 issued to Seward on Oct. 5, 1909. Both illustrate the state of the art regarding devices constructed from an initially flat piece of manually bendable material. The Mayhew U.S. Pat. No. 4,055,250 in particular shows a truck design having material pre-printed on one side thereof. As will be apparent to those of skill in the art, the Mayhew design is considerably different from the present invention and results in an open topped structure for containing display merchandise to be sold. See items 16 at FIG. 1 of the Mayhew patent.

BRIEF DESCRIPTION OF THE DRAWING FIGURES

FULL DESCRIPTION OF THE PREFERRED EMBODIMENT

Figure 1:
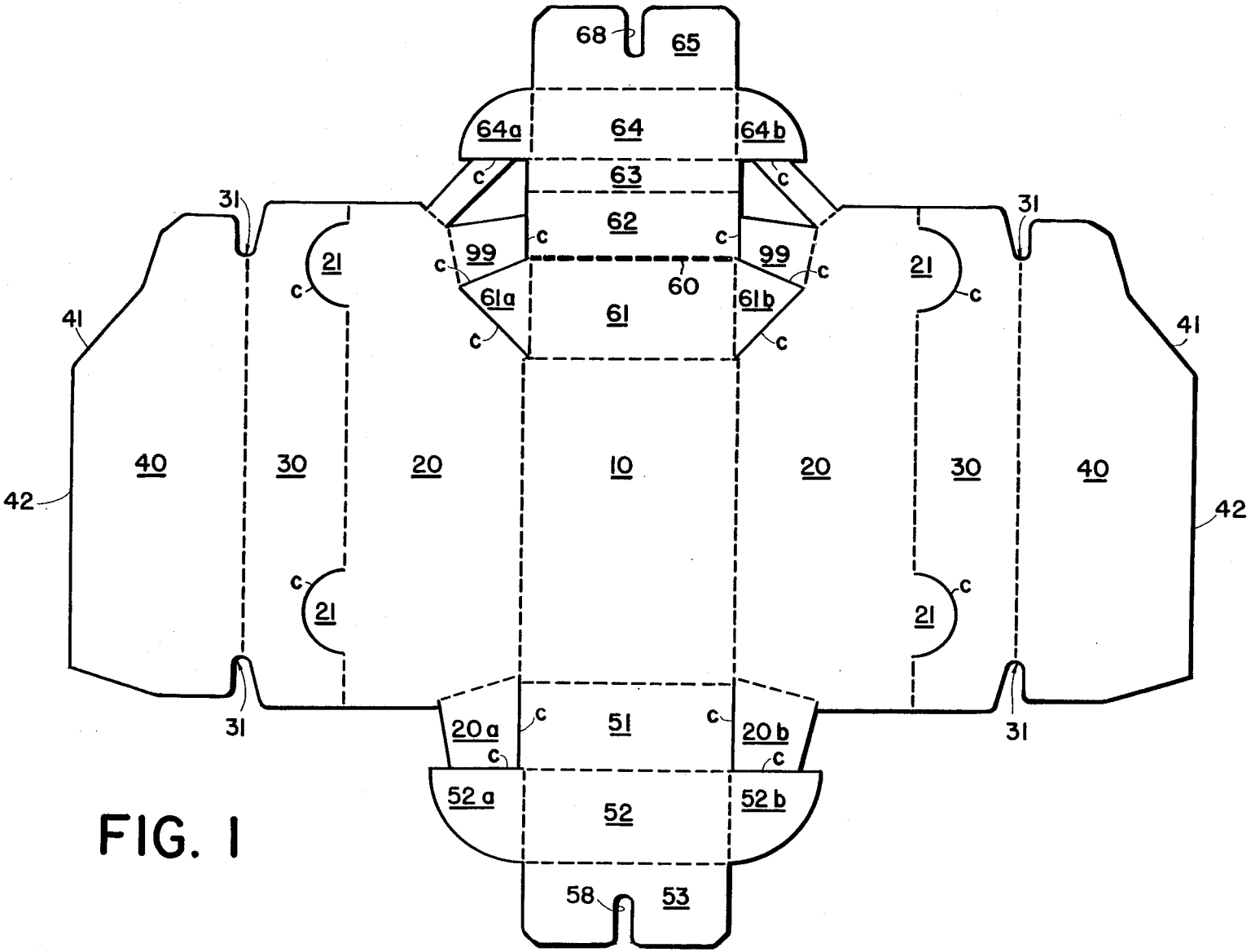
FIG. 1 is a plan view of a flat sheet of corrugated fiberboard having cuts and score lines formed thereon in a design which may be folded easily into the shape of a miniature delivery van.
Figure 2:
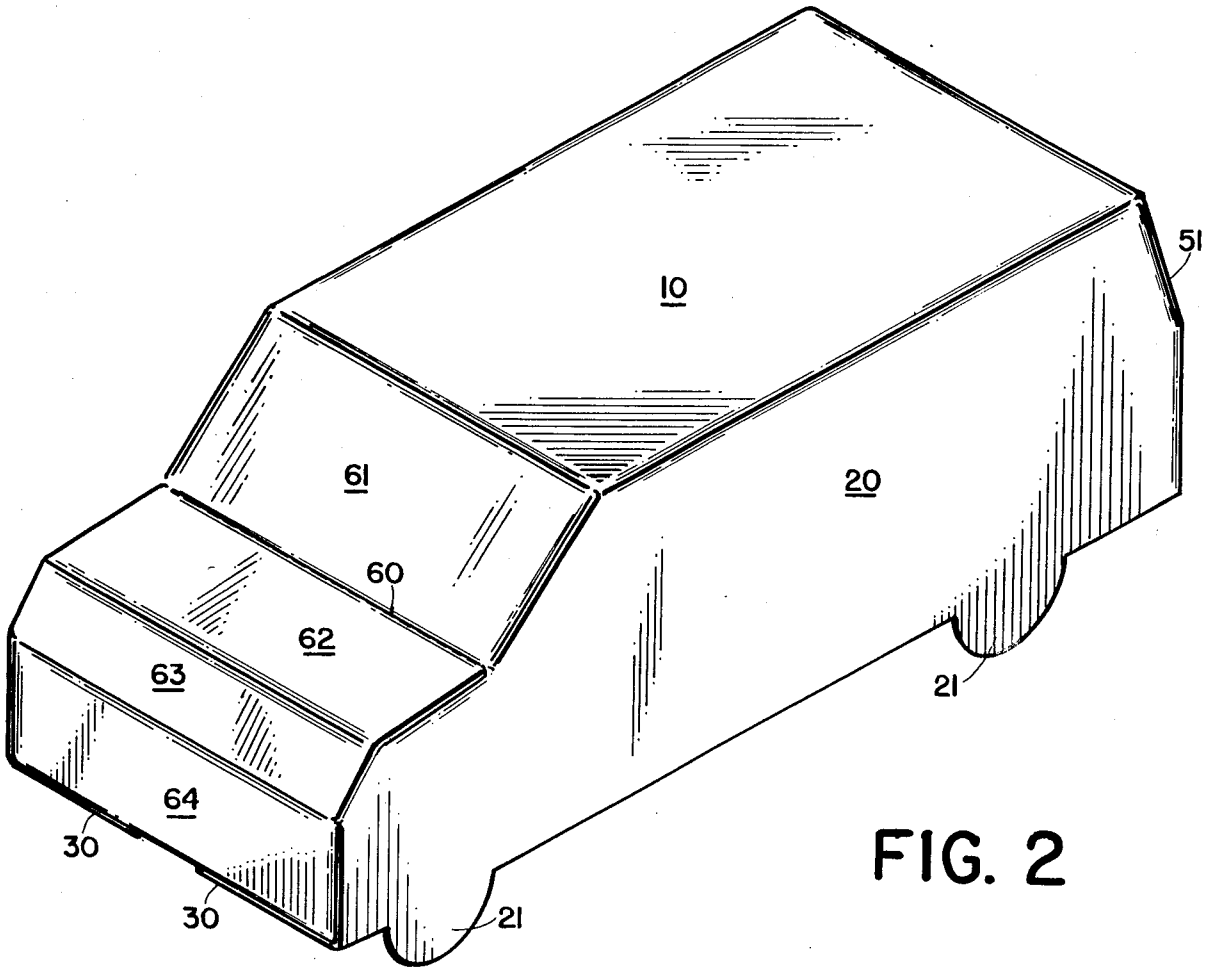
FIG. 2 is a view of the delivery van in its assembled condition for display use.

Referring now to FIG. 1, there is shown a central section 10 which, upon assembly, will form the inner roof portion of the display van.

Van side panels 20 are formed on both sides of the central section 10 by means of score lines therebetween. Side panels 20 include factory cut wheel portions 21.

As shown in its flat position, the corrugated fiberboard has factory applied fold lines shown as dashed lines and factory applied cut through portions shown as solid lines and normally designated by the letter C.

Adjacent to the side panels 20 are two sections 30 which will, upon assembly, form the bottom van paneling.

As further shown in FIG. 1, two sections 40 are attached to van bottom sections 30 by means of score lines therebetween. The two sections 40 will, upon assembly, serve as the central retaining means for the entire assembly by way of slots 31 formed therein.

Shown beneath the central roof section 10 are two rectangular panels 51 and 52 which form the inner rear door panels of the van upon assembly.

A back slotted retaining flap 53 is attached to the lower panel 52 and is defined by the score line means shown. Flap 53 has slotted portion 58 formed therein.

Shown above the central roof section 10 are the inner portions of the windshield panel 61, inner hood panels 62 and 63, and the inner portions of the grill panel 64.

A front slotted retaining flap 65 is attached to the grill panel 64 as defined by the score line means shown between said elements. Flap 65 has slotted portion 68 formed therein.

Various alignment and filler tuck-in tab means are indicated at numerals 64*a*, 64*b*, 99, 61*a*, 61*b*, 20*a*, 20*b*, 52*a* and 52*b*. The purpose of these tab elements is best described with reference to the method of assembly of the invention.

To assemble the device, end sections 40 are rolled inwardly along the multiple score lines shown between sections 10, 20, 30 and 40 such that the outer edges 42 of the sections 40 are in contact with the inner roof section 10. In this position, sections 40 are in side-by-side edge-aligned relationship to each other.

Next, tabs 20*a* and 20*b* are folded inwardly ninety degrees, as are tabs 52*a* and 52*b*.

Rear panels 51 and 52 are then folded upwardly such that tabs 52*a* and 52*b* lie just inside the side panels 20. In this position, the retaining flap means 53 is folded inwardly such that its slotted portion 58 slides over the dual wall formed by the side-by-side positioning of the end sections 40. Slot 58 thus engages the slot means 31 formed in the rear of the van assembly.

The rear portion of the van is now firmly in place.

To complete the front portion of the van, tab portions 61*a*, 61*b*, 99, 64*a* and 64*b* are folded inwardly, i.e. out of the page as shown, approximately ninety degrees. Note that this last folding step may be done before the start of assembly. The front sections 61, 62, 63 and 64 are then folded downwardly along their separating score lines to a position wherein tabs 61*a* and 61*b* may be positioned inside the side panel walls 20 and wherein tabs 64*a* and 64*b* may also be positioned inside the side panel walls 20. The front retaining flap means 65 is then folded inwardly such that its slotted portion 68 slides over the dual wall formed by the side-by-side positioning of the end sections 40. Slot 68 thus engages the slot means 31 formed in the front of the van assembly.

In the assembled position, the windshield section 61 is pushed downwardly to conform to the sloped wall portions 41 of the end sections 40. Thus panel 62 may be folded outwardly to form the van hood by reason of the perforated score line 60. It should be noted that score line 60 is the only perforated score line in the assembly. The other score lines shown between the various sections are indented score lines which tend to allow folding only in an inward direction.

It is also important to note that the solid line portions designated by the letter C are factory cut through lines which allow the appropriate folding of the various tab elements 20*a*, 20*b*, 52*a*, 52*b*, 61*a*, 61*b*, 99, 64*a* and 64*b* as well as the formation of the van wheel elements at 21.

The shapes of the sections and tab elements are of great importance to the overall design. For example, the fact that the score lines of the tabs 20*a* and 20*b* are angled relative to the horizontal results in a sloping rear van window, an important feature in achieving the desired realistic effect. As another example of the importance of the design shape, the quarter circular edges of tabs 52*a*, 52*b*, 64*a* and 64*b* greatly facilitate a rapid assembly of the device.

It is contemplated that printed material would be applied to the corrugated fiberboard by conventional printing processes or, for example, by the addition of a vinyl pre-printed layer.

Because of the flat shipping position of the inventive device, it may be economically transported in large quantities thus yielding a highly desirable promotional tool which may be readily assembled by retail merchants or by collectors of the design.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A promotional delivery van assembly device comprised of easily foldable material, said van assembly including:

a first generally rectangularly shaped central section means (10) which upon assembly forms (the) an inner top roof of the delivery van, said first means (10) having lateral portions formed thereon, second section means (20) attached via score lines to each lateral portion of said first section means (10), said second section means (20) forming (the) van side panels upon assembly, said second section means (20) having wheel portions (21) formed on (the) sides thereof remote from said first section means (10), third section means (30) attached via score lines to said second section means (20), said third section means (30) being positioned in adjacent relation upon assembly to form (the) a van bottom panel, fourth section means (40) attached via score lines to said third section means (30), said fourth section means (40) having a first sloped outer wall portion means (41) and a second outer wall portion means (42) being substantially parallel to said first central section (10), said fourth section means (40) comprising two identical outer sections (40, 40) and being positioned in edge-aligned relation upon assembly such that said second outer wall portion means (42) is in contact with said first central section means (10), said device further including rear panel means (51, 52) comprising a first rear panel (51) attached to said first central section (10) via a score line therebetween and a second rear panel (52) attached to said first rear panel (51) via a score line, said device further including front panel means (61, 62, 63, 64) comprising first (61), second (62), third (63) and fourth (64) rectangular panels with said first rectangular front panel (61) being joined to said first central section (10) via a score line, wherein said second rear panel (52) has tab means (52*a*, 52*b*) formed on side portions thereof, said tab means being folded ninety degrees and placed internally of the van upon assembly, wherein said first front panel means (61) has tab means (61*a*, 61*b*) formed on side portions thereof, said tab means being folded ninety degrees and placed internally of the van upon assembly, wherein said fourth front panel means (64) has tab means (64*a*, 64*b*) formed on side portions thereof, said tab means being folded ninety degrees and placed internally of the van upon assembly, wherein said second section means (20) has tab means (99) formed thereon, said tab means (99) being folded ninety degrees upon assembly so as to underlie the second front panel means (62).

2. The apparatus of claim 1 wherein said second rear panel (52) has a retaining flap means (53) attached thereto, said retaining flap means (53) having a slotted central portion (58) formed therein for joining with a slot means (31) formed between said third and fourth sections (30, 40) upon assembly of the device.

3. The apparatus of claim 1 wherein said rectangular front panel means (61, 62, 63, 64) are joined to each other via score lines formed therebetween.

4. The apparatus of claim 1 wherein said fourth rectangular front panel means (64) has a retaining flap means (65) attached thereto via a score line and wherein said retaining flap means (65) has a slotted portion means (68) formed therein for joining with a slot means (31) formed between said third and fourth sections (30, 40) upon assembly of the device.

5. The apparatus of claim 1 including perforated score line means (60) formed between said first front panel (61) and said second front panel (62) whereby said first panel (61) may be positioned adjacent to the sloped outer wall portion (41) of said fourth section means (40) upon assembly of the device.

* * * * *